United States Patent [19]

Bianchetta et al.

[11] 4,230,022

[45] Oct. 28, 1980

[54] HYDRAULIC ROCK BREAKER CIRCUIT FOR AN EXCAVATOR

[75] Inventors: Donald L. Bianchetta, Coal City; Lawrence F. Schexnayder, Joliet, both of Ill.

[73] Assignee: Caterpillar Tractor Co., Peoria, Ill.

[21] Appl. No.: 1,492

[22] Filed: Jan. 8, 1979

Related U.S. Application Data

[63] Continuation of Ser. No. 729,527, Oct. 4, 1976, abandoned.

[51] Int. Cl.[3] ..... F15B 11/16

[52] U.S. Cl. ..... 91/516; 91/46; 91/518; 91/532

[58] Field of Search ..... 91/461, 46, 513, 516, 91/518, 532; 137/101, 119

[56] References Cited

U.S. PATENT DOCUMENTS

| | | | |
|---|---|---|---|
| 3,568,868 | 3/1971 | Chichester | 91/412 |
| 3,570,519 | 3/1971 | Bianchetta | 91/516 |
| 3,703,186 | 11/1972 | Brewer | 91/412 |
| 3,709,098 | 1/1973 | Lloyd | 91/46 |
| 3,915,501 | 10/1975 | Cobb | 173/43 |
| 3,937,129 | 2/1976 | Miller | 91/412 |
| 3,979,907 | 9/1976 | Paul | 91/412 |
| 4,024,797 | 5/1977 | Johnson | 91/412 |

*Primary Examiner*—Abraham Hershkovitz
*Attorney, Agent, or Firm*—Sheldon R. Meyer

[57] ABSTRACT

A hydraulic control system having a pump and circuits connecting the pump to a pair of hydraulic motors through first and second circuits is provided with a priority valve system operative to provide a priority of fluid pressure to the first motor up to a predetermined minimum pressure and thereafter to maintain the pressure in the first circuit and simultaneously supply fluid to the second motor of the second circuit. The priority valve system is also responsive to a load on a second motor to split the flow of fluid between the two motors above the predetermined minimum pressure up to a second pressure after which the second predetermined pressure is maintained in the first circuit while fluid is being supplied to the second conduit.

6 Claims, 2 Drawing Figures

HYDRAULIC ROCK BREAKER CIRCUIT FOR AN EXCAVATOR

This is a continuation of Ser. No. 729,527, filed Oct. 4, 1976, now abandoned.

BACKGROUND OF THE INVENTION

The present invention relates to hydraulic systems and pertains particularly to a hydraulic system for excavator mounted dynamic rock breakers.

The circuit of the present invention is devised particularly for use in hydraulic excavator mouted rock breakers such as those disclosed in U.S. Pat. No. 3,915,501. The rock breaker, as disclosed in the aforementioned patent, includes an impact-driven ripper tip mounted on the outer end of the boom of the excavator for breaking rock, concrete and the like. The mounting of the breaker on the excavator facilitates the manipulation of the breaker to positions normally hard to reach. The rock breaker system is driven by a hydraulic motor with hydraulic fluid supplied by the system of the hydraulic excavator itself.

One convenient source of pressure for operation of the rock breaker element is the swing circuit of the excavator. The swing circuit is that circuit which rotates the platform of the excavator. Since that circuit is not normally in operation or required at the same time that the rock breaker is in operation, the fluid thereof may conveniently be supplied to operate the rock breaker itself. In such a system, however, it is desirable that proper priority be maintained between the swing motor of the vehicle and the breaker motor. Accordingly, the present invention is devised to meet these requirements.

SUMMARY OF THE INVENTION

It is the primary object of the present invention to overcome the above problems of the prior art.

Another object of the present invention is to provide a hydraulic system having separate circuits with priority valve means for providing a priority of fluid to one circuit up to a minimum pressure and thereafter supplying fluid to the other circuit.

A further object of the present invention is to provide a hydraulic system having first and second circuits with first and second motors supplied thereby from a single source of pressurized fluid, and a priority valve system operative to provide a priority of fluid to the first circuit for operation of the first motor up to a predetermined minimum pressure and thereafter maintaining said pressure in the first system while providing for any leakage incorporated therein and while supplying fluid for operation of the second circuit.

The primary aspect of the present invention comprises a hydraulic system having a source of pressurized fluid for supplying first and second circuits including first and second hydraulic motors with a priority valve system for establishing a priority of fluid up to a minimum pressure to the first of the circuits before fluid is supplied to the second circuits.

BRIEF DESCRIPTION OF THE DRAWINGS

The above and other objects and advantages of the present invention will become apparent from the following description when read in conjunction with the drawings wherein.

DETAILED DESCRIPTION OF THE PREFERRED EMBODIMENT

Figure 1:
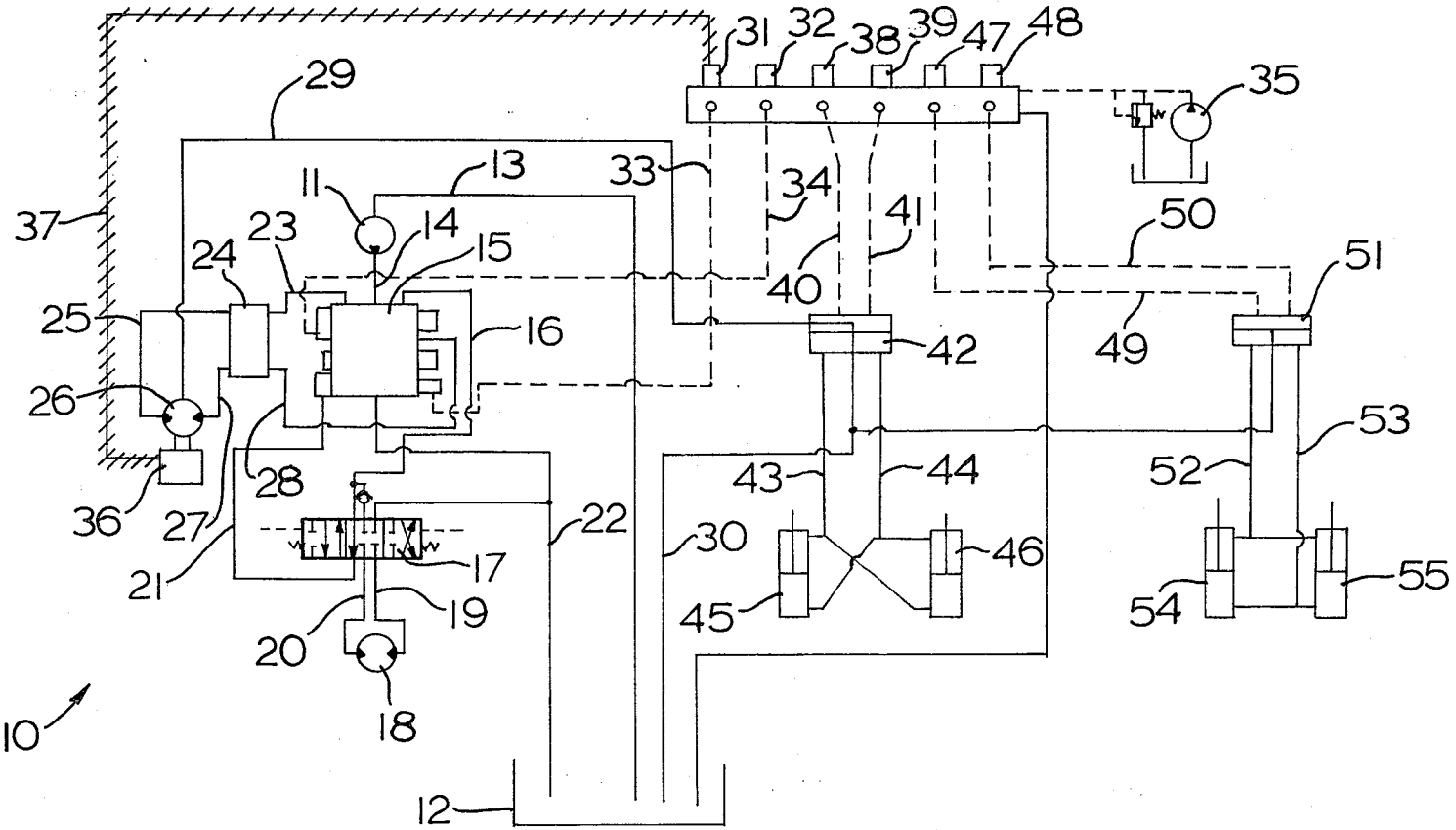
FIG. 1 is a schematic layout of a circuit in accordance with the present invention.

Turning now to FIG. 1 as illustrated, the circuit, in accordance with the present invention, generally designated by the numeral 10, comprises a source of pressurized fluid such as a pump 11 which draws fluid from a reservoir 12 by way of conduit means 13 and supplies it by way of conduit means 14 to a priority control valve system 15 which controls the disposition of the fluid to first and second circuits.

The first circuit means comprises a supply conduit 16 that supplies pressurized fluid to a directional control valve 17 which directs fluid to and from a reversible rotary motor 18, such as the slew motor of an excavator, by way of motor control lines 19 and 20. A return line 21 returns the fluid by way of the priority valve assembly 15 and a return line 22 to the sump or tank 12. The priority valve 15 functions to supply a priority of fluid up to a certain predetermined minimum pressure to the first circuit means just described and thereafter supplies any available fluid to a second circuit.

The second circuit comprises a fluid supply line 23 communicating by way of a make-up valve 24 to a motor control line 25 for supplying pressurized fluid for operation of the rock breaker drive motor 26. Return fluid from the motor 26 is by way of a return line 27 to the makeup valve 24 and a return line 28 to the priority valve system 15 and therethrough to the sump return line 22. A motor drain line 29 is provided for draining leakage from the motor 26 and a return or leakage line 30 to the sump 12.

The priority valve control assembly 15 is controlled by pilot fluid from solenoid-operated pilot control valves 31 and 32 which supply pressurized pilot fluid by way of lines 33 and 34 from a pilot pump 35 to the valve assembly 15 for control thereof. The valves 31 and 32 are solenoid-operated valves for remote control thereof, and the valve 31 is operative in response to a pressure-responsive switch means 36 in the lubricating system of the rock breaker motor 26. The switch 36 is responsive to a lubricating bore pressure in the front breaker motor of the system and initiates an electrical signal which is communicated by way of an electrical conductor 37 to the solenoid switch 31 for operation or actuation thereof.

The rock breaker circuit also includes a pair of solenoid-operated valves 38 and 39 for pilot control by way of pilot lines 40 and 41, by way of lock valve 42, and motor control lines 43 and 44 for operation of a pair of hydraulic cylinders 45 and 46 for rotation of the rock breaker itself with respect to its mounting on the boom of the excavator.

A lock or latch circuit for the rock breaker includes a pair of solenoid-operated valves 47 and 48 operating through a pair of pilot lines 49 and 50 by way of a lock valve 51, and motor lines 52 and 53 for operation of a pair of hydraulic motors or cylinders 54 and 55 for operation of the latching assembly of the rock breaker.

Figure 2:
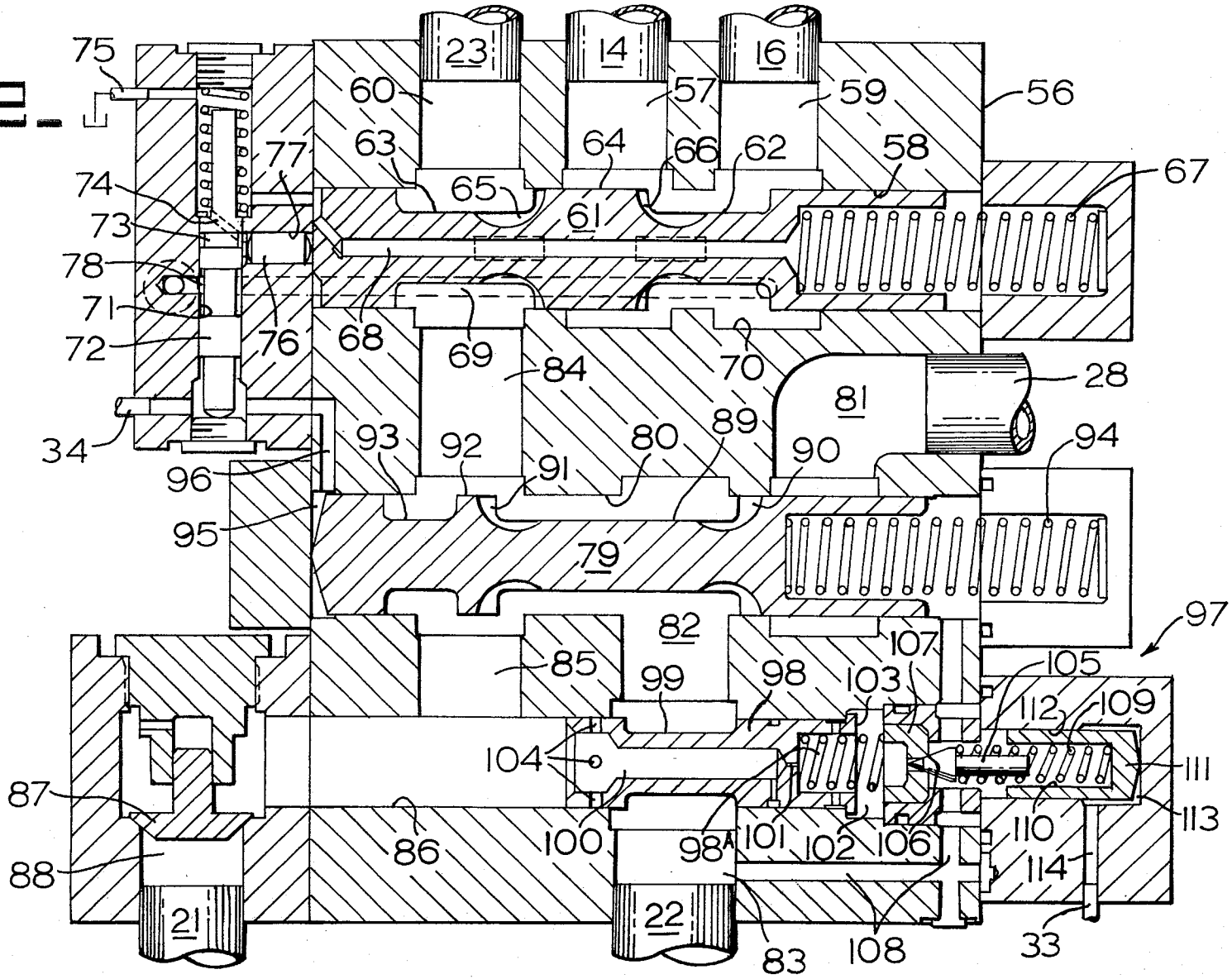
FIG. 2 is a plan view in section of the priority valve assembly of the system of FIG. 1.

The priority valve assembly, FIG. 2, comprises a housing 56 having an inlet port 57 communicating supply line 14 with a cylindrical bore 58 which in turn communicates with a pair of outlet ports 59 and 60. The outlet port 59 communicates with supply conduit 16 for supplying fluid for operation of the swing motor 18, and the outlet port 60 communicates fluid with outlet conduit or supply conduit 23 for supplying fluid for operation of the breaker motor 26. A spool 61 is reciprocably disposed in the bore 58 and functions to communicate or control communication between the inlet port 57 and the outlet ports 59 and 60. The spool 61 includes or is constructed to define a pair of annular grooves 62 and 63 separated by a land 64. These grooves are operative to control the communication or provide the communication between the inlet and the outlet ports, with the land 64 serving to block communication in the usual manner. The plurality of key-way type slots 65 and 66 are provided in the respective annular grooves adjacent the land 64 for providing modulation of the fluid between the ports in the usual manner. The spool 61 is biased by suitable biasing means such as a spring 67 to the leftward-most position to provide normal open communication between inlet port 57 and outlet port 59. A vent passage 68 formed in spool 61 vents the spring chamber and prevents locking of the spool. A pilot control passage 69 communicates between an annulus 70 formed within bore 58 in communication with port 59 and with a bore 71 in which is disposed a pressure-responsive pilot control valve 72. The valve spool 72 includes an annular groove 73 communicating with a passageway 75 by way of a vent passage 74 and with the end of a piston 76 disposed in a bore 77. The piston 76 acts on the end of valve spool 61 when pressure is applied thereto. The valve spool 72, when in the position as shown, vents the end of piston 76 to allow the valve spool 61 to be biased to its left-most position, as shown, by spring means 67. The valve spool 72 also includes an annular groove 78 which is operative when the valve 72 is shifted upward to communicate passageway 69 with the end of piston 76 for communicating the pressure of fluid in swing motor port 59 with the end of piston 76 for acting on the valve 61 for shifting the valve to the rightward position. The valve 72 is shifted upward in response to pilot pressure introduced thereto by way of pilot line 34 and solenoid-operated pilot valve 32. Thus, when valve 72 is pilot operated to the upper position and sufficient build-up of pressure exists in swing motor port 59 for communicating the pressure thereof to the piston 76 for shifting the valve 61 to the rightward direction the valve will begin to close off communication of fluid of port 57 to port 59 by way of annular groove 62 and will begin to open communicating between inlet 57 and outlet 60 by way of groove 63 and slot 65.

It will be seen that the spool 61 and its associated controls are operative to divert all fluid from inlet 57 to outlet 59, which, in this instance, is the swing motor control port, until pressure within the port 59, or more particularly in annular port 70, reaches a predetermined minimum pressure sufficient to act on piston 76 and shift the spool 61 to the right. At a predetermined minimum pressure such as, for example, 1,700 p.s.i., the spool 61 has shifted to the right to a point to begin modulating flow thereto by way of slot 65 and as the pressure reaches 2000 p.s.i. the spool 61 has shifted sufficiently to substantially block flow to port 59 yet maintain the 2000 p.s.i. plus needed flow therein while at the same time diverting the available flow of fluid to the second circuit by way of motor port 60.

A second pilot-operated valve spool 79 is reciprocably disposed in a cylindrical bore 80 for controlling flow of fluid between motor return port 81 and a passage 82 communicating with drain or sump return port 83. The valve 79 also controls communication between a passage 84 communicating with port 60, a passage 85 communicating by way of a bore 86, and a check valve 87 with a motor return port 88 from a swing motor 18. The valve 79 includes an annular groove 89 having metering slots 90 and 91 for metering fluid flow in the usual manner. The groove 89 is separated by means of a land 92 from a second annular groove 93. The spool 79 is normally biased to the position as illustrated by means of spring means or the like 94 and is shifted to the right against the spring 94 by pilot pressure communicated to a chamber 95 at the left end thereof by means of a pilot line 96.

A dual-stage relief valve assembly generally designated by the numeral 97 is provided for the rock breaker circuit of the system. This dual-stage relief valve comprises a dump spool 98 mounted within bore 86 and including an annular groove 99 permitting communication between passage 82 and port 83. A central passageway 100 communicates by way of an orifice or restricted passageway 101 with a pressure chamber 102 wherein pressure acts on the end 103 of spool 98 to bias the spool to its position as shown. A plurality of passages 104 communicate with the passage 100 and the outer diameter of the spool 98 such that when the spool is shifted to the right, open communication exists between passage 85, bore 86 and the sump port 83. The spool 98 is normally biased to its non-dumping position as shown by means of spring 98A.

A poppet-type relief valve including a plunger 105 seated within a seat 106 of a valve seat member 107 controls communication of fluid pressure within chamber 102 and a vent passage 108. The plunger 105 is biased to its seated position by means of a spring 109 encased within a bore 110 of a piston 111. The piston 111 is reciprocably disposed within a bore 112 having an enlarged chamber 113 to which is communicated pilot fluid by means of a port 114 from pilot line 33. In the absence of pilot pressure within chamber 113 of the piston 111, resting as illustrated, the bias in plunger 105 is solely by means of the bias of spring 109. However, upon the introduction of pilot pressure within chamber 113, the shifting of piston 111 to the left increases pressure applied to spring 109 thus increasing the force acting on the plunger 105, biasing it to its seat 106. Thus, the dual stage relief valve operates at a first stage under the sole effect of decompression in spring 109 and a second or higher pressure stage under the increased influence of spring 109 by piston 111.

OPERATION

Considering the operation of the device, it will be appreciated that the boom of the machine will first be swung into position for operation of the impact rock breaker. In this connection, the swing motor 18 will be operated. Thus, looking at FIG. 1, the pump 11 will be operated supplying fluid by way of conduit 14 to the priority valve system 15 which will be conditioned as illustrated in FIG. 2 to communicate fluid to supply line 16 and control valve 17 which in turn controls the supply of fluid for operation of the motor 18. Should it be desirable to operate the rock breaker, then solenoid-operated pilot control valve 32 will be actuated communicating pilot fluid from pump 35 by way of pilot line 34 to the valve assembly 15 wherein the fluid pressure acts on the ends of valves 72 and 79 shifting valve spool 79 to the right-most position. Shifting valve spool 72 to the upward position communicates pressure from annulus 70 to the end of piston 76 to act on the end of valve spool 61. When the pressure in annulus 70 has reached sufficient pressure to shift spool 61 to the right, it will substantially block communication between inlet port 57 and motor port 59 and direct available fluid from inlet port 57 to motor port 60 for the rock breaker circuit for operation of the breaker motor 26. It will be appreciated that until pressure builds up sufficiently in motor line 59 and annulus 70 to shift spool 61 to the right, all flow coming in inlet 57 will be directed to the control circuit for the swing motor 18. The pressure within these ports 59 and 70 will reach sufficient pressure to shift spool 61 to the right sufficient to open communication by way of slot 65 to motor port 60 for the rock breaker motor 26, and land 64 will begin to cut down the flow to port 59, thus the flow will then begin to be diverted to the rock breaker circuit.

When pilot pressure has been communicated through line 34 to chamber 95 at the end of spool 79, spool 79 will have been shifted to the right such that land 92 blocks communication between port 84 and the exhaust passage 82 to the outlet 83. Communication will have been established between the exhaust port 81 of the rock breaker motor 26 and the return or sump passage 83. At the same time, communication will have been opened up between the return line 21 from the motor 18 of the swing circuit to passage 84 and motor line 23 of the motor 26 such that if sufficient pressure is communicated or flow is communicated to motor 18 to operate the same, bypass fluid therefrom will be communicated to the motor 26. However, should the flow to motor 18 be substantially cut off, and all available flow from inlet 57 directed by way of outlet port 60 to motor 26, then check valve 87 will close such that the dual-stage relief valve 87 will become responsive to the pressure within port 80 and motor line 23. This allows the rock breaker motor 26 to be operated at a higher pressure, i.e., 3,000 to 3,500 p.s.i. while pressure is maintained in the first circuit.

After motor 26 begins operation, and the lubrication pressure within the motor builds up to a predetermined minimum pressure, pressure-responsive switch 36 will be activated sending a signal to operate solenoid-operated pilot control valve 31 to communicate a pressure signal by way of pilot line 33 to the pilot control chamber 113 of the dual-stage relief valve 97 for shifting the piston 111 to the left and thereby upstage the relief valve 105 to a second pressure. This dual-stage relief valve prevents high-speed operation of motor 26 until lubrication pressure therein builds up sufficiently to send a signal activating the solenoid pilot valve 31 to upstage the relief valve 97.

It will be appreciated that the valve 61 will continuously respond to pressure within the annulus 70 to maintain the valve 61 to the right-hand position. Thus, should pressure within annulus 70 drop below a second predetermined pressure of 2,000 p.s.i., the spool will move to the left sufficiently so fluid will communicate by way of metering slots 66 to the annulus 70 and thereby by way of passage 69 to act on piston 76 to maintain the spool 61 in its shifted position, whenever the system pressure in inlet port 57 is in excess of 2,000 p.s.i.

When the motor 26 is operational and the first circuit is energized the valve 61 will meter flow into the first circuit through metering slots 66. If the motor 18 reaches a stalled condition, only sufficient flow to maintain 2,000 p.s.i. will be supplied to the first circuit, assuming the pressure in the second circuit is above 2,000 p.s.i. If first circuit pressure is less than 1,700 p.s.i., the swing control valve 17 will receive all the flow required at the pressure of 1,700 p.s.i. or less.

Thus, it will be appreciated that the system described above includes a pair of distinct circuits controlled by a priority valve assembly operative to provide priority of one circuit over the second circuit at a pressure up to a predetermined minimum pressure, and thereafter maintaining a pressure in the first circuit while directing fluid for operation of the second circuit. Should the circuits be put in operation at the same time, the priority will still pervail to the extent that the system will maintain a minimum pressure and flow in the first circuit before pressure is communicated to the second circuit.

While the present invention has been described by means of the specific embodiment, it is to be understood that numerous changes and modifications may be made therein without departing from the spirit and scope of the invention as defined in the appended claims.

What is claimed is:

1. A hydraulic control system comprising:

a source of pressurized fluid;

first circuit means for communicating pressurized fluid from said source for operation of a first motor;

second circuit means for communicating pressurized fluid from said source for operation of a second motor;

priority valve means disposed between said source and said first and said second circuits for communicating all fluid from said source to said first circuit until the pressure thereof reaches a predetermined minimum and thereafter maintaining said predetermined pressure in said first circuit and communicating all available flow to said second motor, and a dual-stage relief valve for said second circuit, wherein said dual-stage relief valve is conditioned to one of said dual-stages by lubricating pressure in said second motor for preventing high-speed operation of said second motor until lubrication pressure builds up therein; and wherein said hydraulic control system includes a pressure responsive means responsive to lubricating pressure in said second motor for operating an activation means through an electrical conductor carrying an electrical signal from the pressure responsive means to the activation means, the activation means conditioning the dual-stage relief valve to said one of said dual-stages through a conduit which provides communication between the activation means and a pilot control chamber of the dual-stage relief valve in response to said electrical signal.

2. The system of claim 1 wherein said dual-stage relief valve includes a spring biased poppet valve, wherein said spring conditions the dual-stage relief valve to the other of said dual-stages, and wherein the end of said spring located distally from said poppet valve is operably associated with a piston, which piston is responsive to the pressure communicated by said activation means to the pilot control chamber.

3. A hydraulic control system comprising:

a source of pressurized fluid;

a priority valve means for communicating with said source;

a first circuit means for communicating with said priority valve, and including a control valve and a fluid motor, wherein said control valve has a first position for communicating fluid from the priority valve with said motor by a work path, and a second position for communicating fluid back to said priority valve by a return path;

a second circuit means including a second fluid motor and being in fluid communication with said priority valve means for selectively communicating fluid from said priority valve for the operation of the second fluid motor, said priority valve including means for selectively directing the fluid from said return path to said second circuit;

means for actuating said priority valve means to selectively (i) communicate all fluid from said source to the fluid motor of said first circuit means when said control valve is in the first position until the pressure thereof reaches a predetermined minimum and thereafter maintaining said predetermined pressure in said first circuit and communicating all available flow to said second circuit; and (ii) communicate all fluid from said source to the second motor of said second circuit when said control valve is in the second position.

4. The apparatus of claim 3 wherein said means for actuating said priority valve means includes means for communicating all flow to said first circuit regardless of pressure level.

5. A hydraulic control system comprising:

a source of pressurized fluid;

first circuit means for communicating pressurized fluid from said source for operation of a first motor;

second circuit means for communicating pressurized fluid from said source for operation of a second motor;

priority valve means disposed between said source and said first and second circuits for communicating all fluid from said source to said first circuit until the pressure thereof reaches a predetermined minimum pressure and thereafter maintaining said predetermined minimum pressure in said first circuit and communicating all available excess flow to said second motor;

wherein said priority valve means includes:

a housing having a cylindrical bore therein;

an inlet communicating said source of pressurized fluid with said bore;

a first outlet communicating said bore with said first circuit;

a second outlet communicating said bore with said second circuit;

a spool disposed in said bore having a first position at which all fluid from said source is directed to said first circuit regardless of pressure, and a second position at which said source is directed to said second circuit;

biasing means for normally biasing said spool to the first position;

piston means for selectively moving said spool to said second position in response to said predetermined minimum pressure;

first conduit means for providing fluid communication between the first outlet and the piston means;

pilot control valve means for controlling the fluid flow in the first conduit means;

wherein the piston means is responsive to the fluid pressure in the first outlet upon actuation of said pilot control valve means;

activation means for controlling said pilot control valve means; and second conduit means for communicating the activation means with the pilot control valve means.

6. The control system, as set forth in claim 5, including a tank, wherein said pilot control valve means includes a second spool having a first position at which the second outlet is connected to the tank and a second position at which the second outlet is blocked from the tank, said second spool being moved to said second position in response to said actuation means.

* * * * *